US005204492A

United States Patent [19]

Jacob et al.

[11] Patent Number: 5,204,492

[45] Date of Patent: Apr. 20, 1993

[54] LOW NOISE, LOW SHRAPNEL DETONATOR ASSEMBLY FOR INITIATING SIGNAL TRANSMISSION LINES

[75] Inventors: Merritt Jacob, Ayrshire, Scotland; Peter F. Reiss, Sugarloaf; Samual G. Stednitz, St. Clair, both of Pa.

[73] Assignee: ICI Explosives USA Inc., Wilmington, Del.

[21] Appl. No.: 784,780

[22] Filed: Oct. 30, 1991

[51] Int. Cl.[5] ..... C06C 5/04; F42B 3/103

[52] U.S. Cl. ..... 102/275.12; 102/275.7; 102/318

[58] Field of Search ..... 102/275.12, 275.2, 275.3, 102/275.4, 275.5, 275.6, 275.7, 312, 318

[56] References Cited

U.S. PATENT DOCUMENTS

| | | | |
|---|---|---|---|
| 927,968 | 7/1909 | Harle | 102/275.4 |
| 1,598,920 | 9/1926 | Mallet | 102/275.4 |
| 1,887,122 | 11/1932 | Duffy | 102/275.7 |
| 1,991,857 | 2/1935 | Lewis | 102/275.7 |
| 2,587,694 | 3/1952 | Chalmers et al. | 102/275.4 |
| 2,952,206 | 9/1960 | Becksted | 102/275.7 |
| 3,175,491 | 3/1965 | Robertson | 102/275.7 |
| 3,349,706 | 10/1967 | Schaumann | 102/275.7 |
| 3,431,849 | 3/1969 | Kern et al. | 102/318 |
| 3,709,149 | 1/1973 | Driscoll | 102/312 |
| 3,713,384 | 1/1973 | Turnbull | 102/275.4 |
| 3,878,785 | 4/1975 | Lundborg | 102/275.4 |
| 3,987,732 | 10/1976 | Spraggs et al. | 102/275.5 |
| 3,987,733 | 10/1976 | Spraggs et al. | 102/275.3 |
| 4,187,780 | 2/1980 | Petruccelli | 102/275.12 |
| 4,248,152 | 2/1981 | Yunan | 102/275.4 |
| 4,350,097 | 9/1982 | Bowman et al. | 102/275.2 |
| 4,424,747 | 1/1984 | Yunan | 102/275.2 |
| 4,714,017 | 12/1987 | Kelly et al. | 102/275.4 |
| 4,714,018 | 12/1987 | Lofgren | 102/275.7 |
| 4,815,382 | 3/1989 | Yunan | 102/275.7 |
| 4,821,645 | 4/1989 | Reiss | 102/275.12 |
| 5,054,396 | 10/1991 | Grommes et al. | 102/275.3 |

*Primary Examiner*—David H. Brown
*Attorney, Agent, or Firm*—Charles Q. Buckwalter

[57] ABSTRACT

A detonator assembly is provided which increases versatility, reliability and safety by initiating any amount of signal transmission lines up to about 8 without emitting excessive noise or shrapnel which can cause cut off or safety hazards. The detonator assembly comprises a low strength detonator with a single charge of preferably lead azide. A high confinement connection block houses the low strength detonator and comprises a retention block in which the low strength detonator is inserted and a confining wall which surrounds the closed end of the low strength detonator. One to about eight signal transmission lines can be inserted through a gap in the confining wall and operatively confined adjacent the closed end of the low strength detonator.

17 Claims, 4 Drawing Sheets

LOW NOISE, LOW SHRAPNEL DETONATOR ASSEMBLY FOR INITIATING SIGNAL TRANSMISSION LINES

TECHNICAL FIELD

The present invention relates to explosives and to components useful in the detonation of explosives. In particular, this invention relates to a detonator assembly that can initiate one or more signal transmission lines without emitting excessive noise and shrapnel.

BACKGROUND OF THE INVENTION

In blasting operations, various arrangements of signal transmission lines, detonator units, delay elements and explosives are used to transmit a blast signal from a remote initiation location to explosives in boreholes. The explosive industry has moved away from detonating cord to low brisance transmission lines. Typically, there are two types of detonator units employed in blasting operations: the downhole unit and the trunkline and delay (T and D) unit. By using these two types of units, different blasting sequences and timing patterns can be arranged.

The downhole unit can be comprised of a length of signal transmission line with one end inserted into a detonator and the other end sealed. The detonator end of this unit is placed down a borehole to initiate a primer charge which initiates an explosive column in the borehole.

The T and D unit can also be comprised of a length of signal transmission line with one end inserted into a detonator and the other end sealed. The T and D unit is employed on the surface of the blast to initiate the signal transmission lines of one or more downhole units and/or other T and D units.

The detonator in the T and D unit can be placed inside a connection block. The detonator together with the connection block is a detonator assembly. The signal transmission lines of downhole units or other T and D units can be placed inside the connection block and compressed against the detonator. When the detonator discharges, the force of the discharge initiates these adjacent signal transmission lines.

In order to reduce noise in blasting operations, the industry has adopted the use of transmission lines, such as those illustrated in U.S. Pat. No. 4,290,366 to Janowski, that typically comprise a hollow tube containing a reactive element which transmits a detonation signal through the tube via a plasma wave. These transmission lines are virtually noiseless and produce no side blasts in contrast to previously employed detonating cord. Although initiation of an open end of the tubes is easily accomplished, initiating the tubes through their sides allows greater variety and simplicity in arrangement of the T and D and downhole units. Means to reliably initiate several signal transmission lines through their sides with one detonator is desirable.

The connection of two lines by connecting the detonator of one signal transmission line to the midpoint of another signal transmission line has been accomplished.

U.S. Pat. No. 3,987,733 to Spraggs et al. discloses a delay surface connector with a length of signal transmission line with a delay cap on each end and a protective block containing each delay cap. One protective block as disclosed has three longitudinal channels for holding one detonator cap and one signal transmission line folded double.

U.S. Pat. No. 3,987,732 to Spraggs et al. discloses a borehole downline unit that is essentially the same concept as Spraggs '733 except that one end of the signal transmission line has a high strength detonator for initiating borehole explosives.

U.S. Pat. No. 3,878,785 to Lundborg discloses an explosive assemblage similar to Spraggs '732 and '733. The connecting blocks as disclosed teach doubling the fuse through channels that run in close proximity to a cap.

Another approach to permit connection of a number of transmission lines involves the stacking of two or more connecting blocks each containing a detonator. U.S. Pat. No. 4,821,645 to Reiss discloses, among other things, a connector that has a well for receiving a blasting cap, one or more ports or channels for receiving a transmission line, and means for joining one connector with another connector. Because of the structure involved, this approach is useful for high strength caps.

Thus far, there has been a need in the industry to minimize shrapnel and noise by reducing the detonator size used in a T and D unit. Reduction in the size of the detonator has been hampered because a suitable connector design was not available which permitted connection of a differing number of transmission lines without loss of reliability.

Reliable initiation of signal transmission lines is a function of three factors: the strength of the detonator, the design of the detonator and the degree of confinement between the signal transmission line(s) and the detonator. If one or two factors are lacking, the other factor(s) must compensate. When the degree of confinement is increased and detonator output optimized by the detonator design, a higher percentage of the detonation energy is absorbed by the signal transmission lines. If a higher percentage of energy is being transmitted and then absorbed when there is increased confinement and optimized design of the detonator, then the strength of the detonator can be reduced and the actual amount of energy absorbed remains the same. It is desirable to reduce the strength of the detonator to decrease noise and shrapnel. The present invention involves an assembly that increases confinement and transfer of explosive energy such that a low strength detonator can be used to reliably initiate not only one signal transmission line but also a plurality of lines.

The detonator used in T and D units has been typically a No. 8 strength cap with 600 to 800 milligrams of secondary explosives as a base charge and 60 to 125 milligrams of primary explosives as a primer charge. Initiation of the No. 8 strength cap not only initiates the signal transmission lines to which it is operatively adjacent, but also completely destroys the connection block along with the entire detonator shell. This highly energetic and destructive detonation throws shrapnel from both the connection block and the detonator shell at very high velocities. This flying shrapnel has the potential of contacting the signal transmission lines of other units and either prematurely initiating them or cutting them such that they cannot transmit a signal. This is typically known as shrapnel "cut off."

Along with shrapnel cut offs, the No. 8 strength caps produce excessively noisy air blasts in excess of 140 db at three meters. In order to reduce the amount of air blast noise and shrapnel thrown by the T and D unit's detonator, the detonator assembly is often buried at the rim of the borehole. This activity requires extra time for completing the already arduous task of loading a blast. However, in demolition of buildings, the disadvantageous noise and shrapnel problems of high strength detonators are even more significant because of the impossibility of burying the units. The reason No. 8 strength caps in detonator units are still used despite these drawbacks is because lower strength detonators of the same design decrease the reliability of initiating signal transmission lines.

If low strength detonators are to be used, the degree of confinement between the signal transmission lines and the detonator must be increased along with the amount of energy transferred to insure reliable initiation. Also, most low strength connection blocks can only accommodate one or two transmission lines. For T and D units to be commercially useful, they must be able to accommodate various numbers of transmission lines connected to the T and D unit. For those connecting blocks that can accommodate several transmission lines, the confinement increases as more transmission lines are connected in the connecting block. However, when a single line is connected to these blocks, many times the confinement is sloppy, and thus another reason for employing a high strength No. 8 cap is to compensate for this lack of confinement. In addition, the connection blocks are designed to operate with higher strength caps. So the confinement block must not only provide enough confinement to insure initiation with a low strength detonator, but it must be versatile enough to accommodate either one or a plurality of signal transmission lines.

The present invention provides a detonator assembly comprising a low strength detonator and a high confinement connection block that effectively initiates a varying number of signal transmission lines, while at the same time eliminating excessive noise and shrapnel. With the elimination of excessive noise and shrapnel there is less likelihood of shrapnel cut off and no need to bury the detonator assembly, thus saving valuable field assembly time. With the ability to initiate a varying number of signal transmission lines, installation is easier, faster and safer with less chance of incorrectly arranging the blasting operation.

SUMMARY OF THE INVENTION

One aspect of the present invention provides a low noise, low shrapnel detonator assembly which can reliably initiate one or a plurality of signal transmission lines. The detonator assembly comprises a low strength detonator together with a high confinement connection block that increases versatility and safety by permitting any amount of signal transmission lines, depending on the signal transmission line diameter and detonator diameter, to be easily connected in operative proximity to the low strength detonator and reliably initiated despite the low strength of the detonator so that noise and shrapnel levels are significantly reduced.

The low strength detonator has a closed end and less than about 150 mg or preferably between about 75 to about 150 mg and most preferably between about 80 to about 125 mg of explosive contained in the closed end. The high confinement connection block has a first end and a second end. The first end is a retention block which holds the low strength detonator with its closed end exposed. The second end is a confining wall extending from the retention block and surrounding the exposed closed end of the low strength detonator. The confining wall has a gap through which one to a plurality of signal transmission lines can be inserted and operatively confined adjacent the closed end between the confining wall and the closed end.

Another aspect of the present invention is solely the high confinement connection block which increases versatility by permitting one or a plurality of signal transmission lines to be easily connected in operative proximity to a detonator for reliable initiation. The high confinement connection block is as described above and may be used with any typical detonator.

Another aspect of the present invention is solely the low strength detonator which can reliably initiate properly confined signal transmission lines while emitting significantly reduced levels of noise and shrapnel. The low strength detonator comprises a shell with a closed end having a single charge of about 150 mg or less of explosives contained within it. The low strength detonator may be used with any connection block that can operatively confine a signal transmission line adjacent to it.

BRIEF DESCRIPTION OF THE DRAWINGS

A more complete understanding of the invention may be had by reference to the following detailed description when taken in conjunction with the accompanying drawings wherein like referenced characters denote like parts in all views, and wherein.

DETAILED DESCRIPTION OF THE INVENTION

Figure 1:
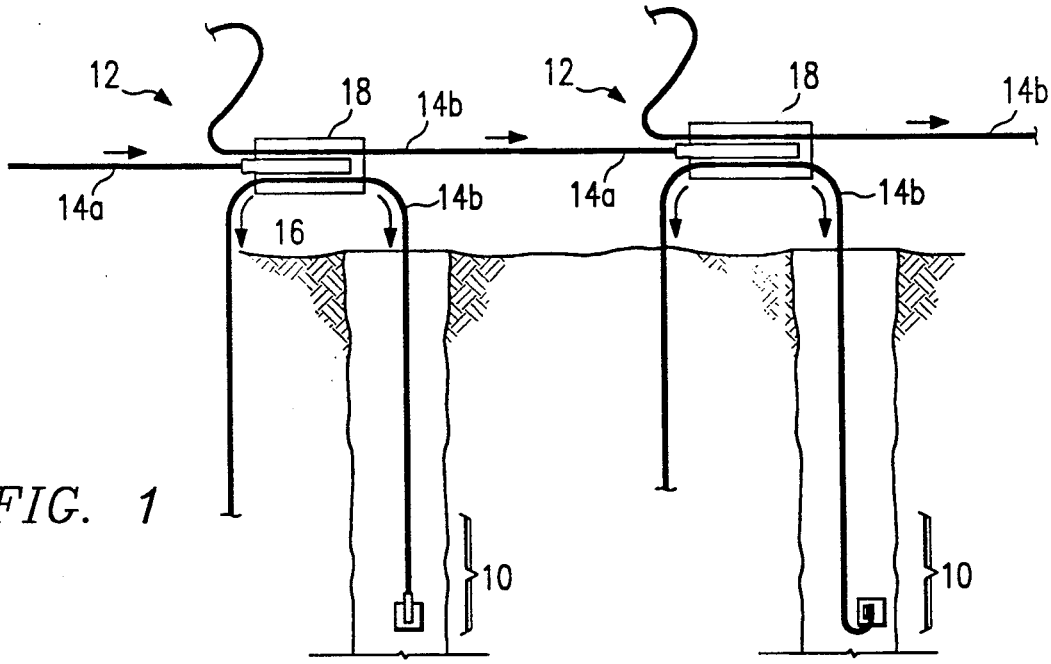
FIG. 1 is a schematic illustration of a general blasting arrangement.

Referring now to the drawings, wherein like reference numerals designate like or corresponding parts throughout the several views, FIG. 1 schematically illustrates a typical blasting arrangement with downhole units 10 and trunkline and delay (T and D) units 12. The T and D units 12 typically have a signal transmission line 14a that transmits a signal to a detonator 16 in a connection block 18. The detonator discharges upon receipt of the signal and initiates other signal transmission lines 14b that are placed near the detonator 16 inside the connection block 18. These initiated signal transmission lines 14b are either part of other T and D units 12 or downhole units 10. Also, the part of the signal transmission lines 14b that is initiated can be the end or any point along the midsection. To increase the usefulness and diversity of the T and D units 12 it is desirable for the detonator 16 and connection block 18 to be able to accommodate and reliably initiate any amount of signal transmission lines 14b up to about eight. FIG. 1 shows only two signal transmission lines 14b in the connection blocks 18 for initiation. The present invention can reliably initiate any amount of signal transmission lines up to about eight. The signal transmission lines 14a and 14b may be any standard type. The preferred embodiment of the present invention can be used to initiate the type illustrated in U.S. Pat. No. 4,290,366 to Janowski made of flexible plastic.

Reliable initiation of signal transmission lines with a detonator assembly is generally a function of 1) the strength of the detonator, 2) the design of the detonator, and 3) the degree of confinement between the signal transmission lines and the detonator. The object of the present invention is to provide a detonator assembly for the initiation of signal transmission lines that has a reduced strength detonator so shrapnel and noise emissions are significantly reduced and an optimized design of the detonator and an increased degree of confinement in order that one to a plurality of signal transmission lines can be reliably initiated by the lower strength detonator.

Optimization of the degree of confinement is achieved by the embodiments of the present invention illustrated in FIGS. 2–11. These various embodiments not only allow a single signal transmission line to be initiated by a low strength detonator but they also allow up to about eight signal transmission lines to be initiated by a low strength detonator. The present invention comprises low strength detonator 30 and high confinement connection block 22. It should be understood that FIGS. 2–11 illustrate only a few of several possible embodiments of high confinement connection block 22.

Figure 2:
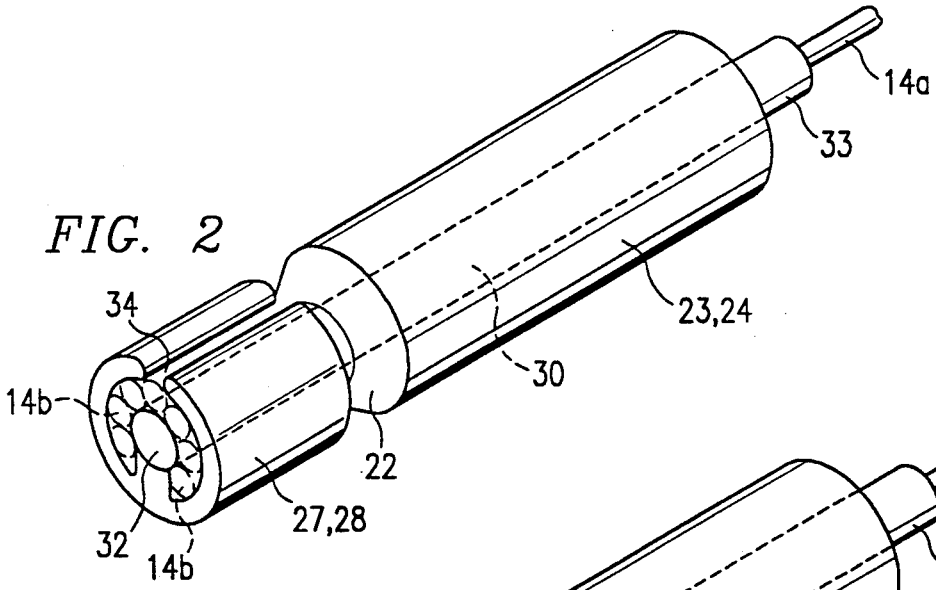
FIG. 2 is a perspective view of a low noise, low shrapnel detonator assembly.

FIG. 2 illustrates one embodiment of the detonator assembly of the present invention. High confinement connection block 22 houses low strength detonator 30. Low strength detonator 30 is shown in phantom and has closed end 32 and open end 33. High confinement connection block 22 has first end 23 and second end 27. First end 23 is retention block 24 which is designed to firmly hold low strength detonator 30 with its closed end 32 exposed. Second end 27 is confining wall 28 which is attached to retention block 24 and surrounds the exposed closed end 32. Confining wall 28 has gap 34 through which one to a plurality of signal transmission lines 14b can be inserted and operatively confined adjacent closed end 32 between confining wall 28 and closed end 32. Confining wall 28 is of a generally cylindrical shape with a first open end towards the retention block and a second open end away from the retention block and with gap 34 running lengthwise. Confining wall 28 is oriented so as to define an annular passageway concentric with closed end 32 of low strength detonator 30. FIG. 2 depicts signal transmission lines 14b chopped off in order to better illustrate the invention and show how the space in connection block 22 is occupied. The nature of confining wall 28 is such that signal transmission lines 14b can be run through the detonator assembly although just the ends of signal transmission lines can be initiated in the detonator assembly if desired. In the embodiment of FIG. 2 the distance between the inside of confining wall 28 and closed end 32 is slightly smaller than the diameter of a signal transmission line. When a signal transmission line is inserted, the confining wall flexes and the signal transmission line compresses to allow the insertion of the signal transmission line. The resulting resiliency of the confining wall and the signal transmission line bears the signal transmission line against the closed end of the low strength detonator and thereby provides the required degree of confinement of the signal transmission line to insure reliable initiation. Confining wall 28 is sized to allow one layer of signal transmission lines to be inserted around closed end 32 thus the inside diameter of confining wall 28 and the number of signal transmission lines 14b that can be operatively confined adjacent closed end 32 depend on the diameter of the closed end and the diameter of the signal transmission lines. The smaller the diameter the signal transmission lines the more of them that can be placed around the closed end. Likewise, the larger the diameter of the closed end the more area for the placement of signal transmission lines.

Figure 3:
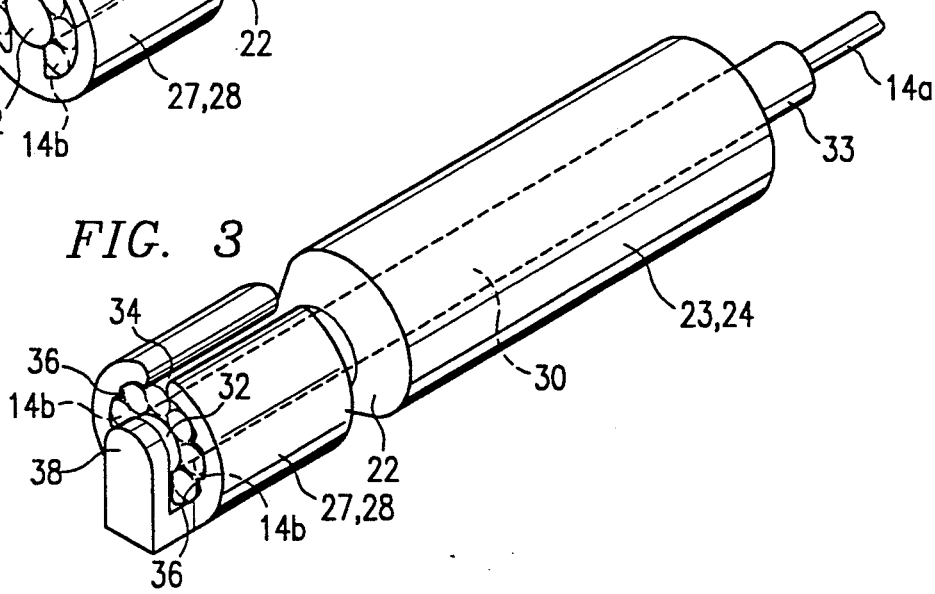
FIG. 3 is a perspective of the preferred embodiment of a low noise, low shrapnel detonator assembly.

FIG. 3 illustrates the preferred embodiment of confining wall 28. Ridges 36 protrude from the inside surface of confining wall 28 parallel to the signal transmission lines. These ridges increase the degree of confinement. The ridges can be spaced such that a single signal transmission line can be inserted operatively adjacent the closed end between two ridges. The ridges also increase the ability of the low strength detonator to initiate just a few signal transmission lines. The inside surface of confining wall 28 can be contoured to create a plurality of longitudinal channels. Each channel can be sized to operatively confine a single signal transmission line 14b along side closed end 32 of low strength detonator 30. When the maximum amount of signal transmission lines are inserted, the mass of signal transmission lines contribute to their own confinement. With the ridges, one signal transmission line can be nested between two ridges and be operatively confined adjacent closed end 32 without requiring other signal transmission lines to also be confined around the closed end.

Also in the preferred embodiment stop wall 38 is attached to the second open end of confining wall 28 so that closed end 32 can be abutted against it. This arrangement also serves to help channel the explosive energy from the closed end through its sidewalls and towards the signal transmission lines confined around the closed end.

Figure 4:
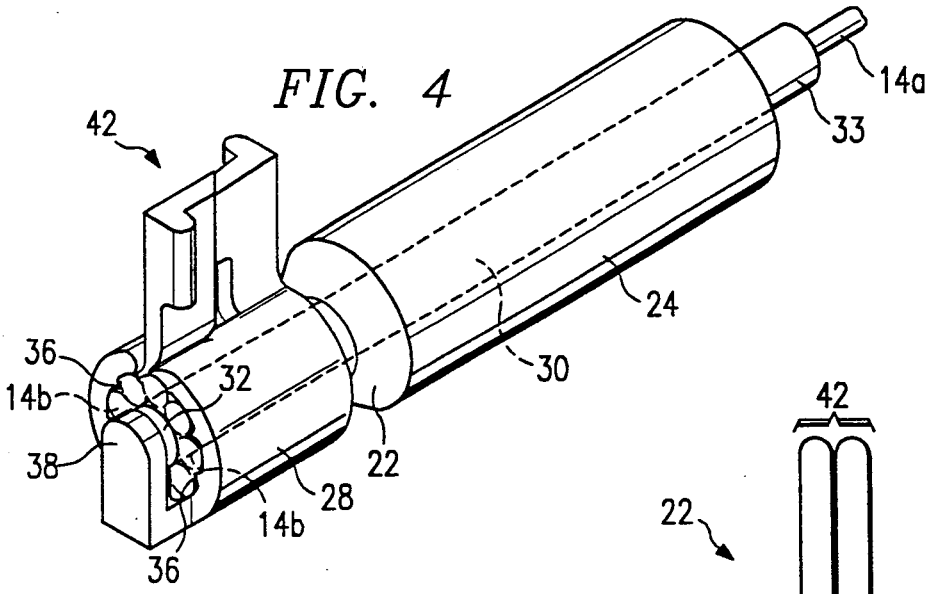
FIG. 4 is a perspective view of an alternative embodiment of a low noise, low shrapnel detonator assembly.

FIG. 4 illustrates an alternative embodiment of confining wall 28. In this embodiment, the confining wall has closure 42 extending from the confining wall on each side of gap 34 and which is closeable over gap 34 to further confine signal transmission lines 14b adjacent closed end 32. In this alternative embodiment with closure 42, the distance between the inside of confining wall 28 and closed end 32 does not have to be less than the diameter of a signal transmission line as long as closure 42 sufficiently tightens the confining wall around the signal transmission lines. Closure 42 can be of a variety of designs as long as it allows easy insertion of signal transmission lines inside confining wall 28 when open and sufficiently tightens the confining wall around the signal transmission lines so as to insure reliable initiation when closed.

Figure 5:
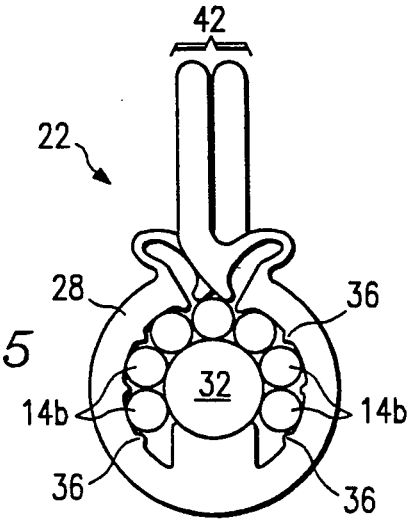
FIG. 5 is an end view of an alternative embodiment of the detonator assembly.
Figure 6:
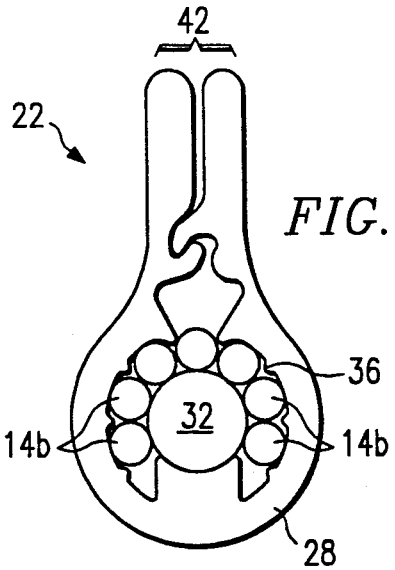
FIG. 6 is an end view of an alternative embodiment of the detonator assembly.
Figure 7:
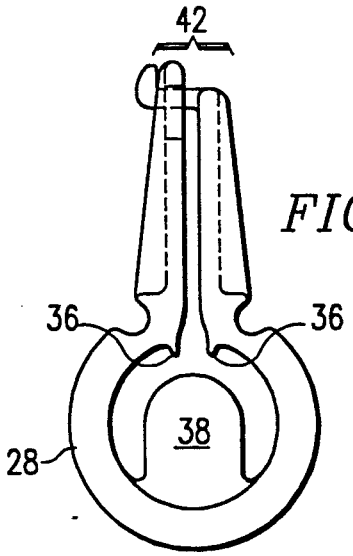
FIG. 7 is an end view of an alternative embodiment of the detonator assembly.

FIGS. 5, 6 and 7 illustrate some alternative closures 42.

Figure 8:
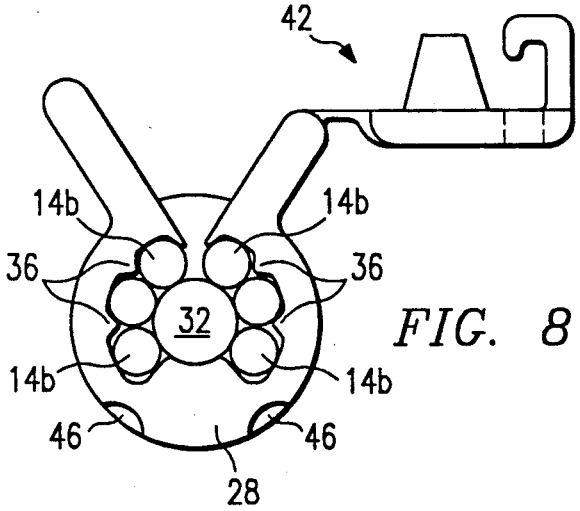
FIG. 8 is an end view of an alternative embodiment of the detonator assembly.

FIG. 8 illustrates another alternative embodiment of confining wall 28. Living hinges 46 lengthwise along the confining wall allow confining wall 28 to be rotated open about the living hinges 46 open for easier insertion of signal transmission lines. The confining wall can then be rotated about living hinges 46 and closed by closure 42. Since living hinges 46 allow the laying open of the confining wall, ridges 36 can be more pronounced to allow increased confinement of a single signal transmission line between two ridges and adjacent the closed end.

Figure 9:
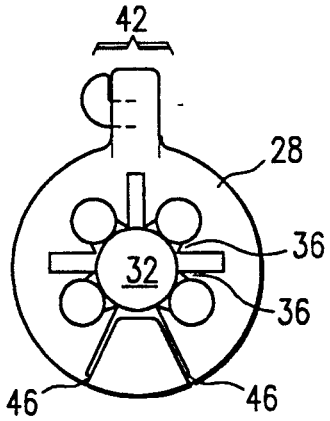
FIG. 9 is an end view of an alternative embodiment of the detonator assembly.
Figure 10:
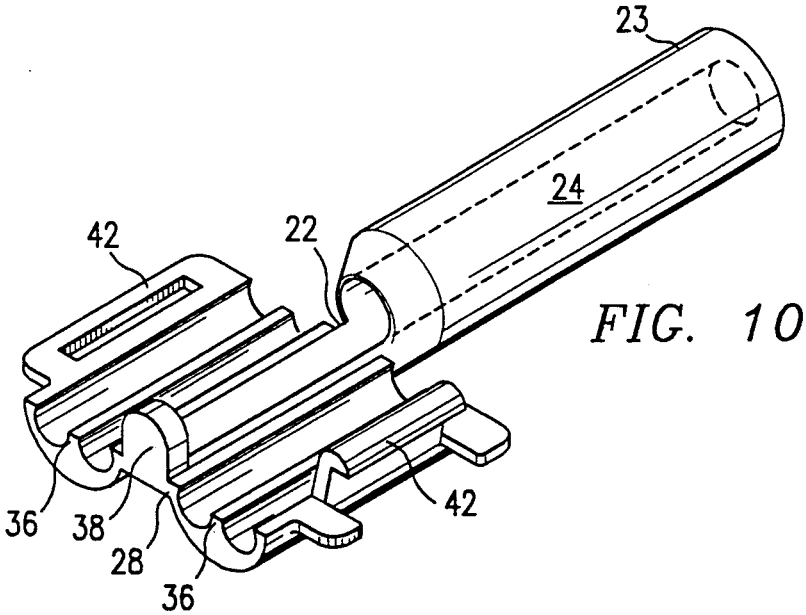
FIG. 10 is a perspective view of an alternative embodiment of the high confinement connection block.

FIGS. 9 and 10 show two more embodiments of connection block 22 having living hinges 46 with pronounced ridges 36. Ridges 36 can extend to the sidewall of the low strength detonator and be curved to mirror the outer surface of the signal transmission lines. This embodiment provides block confinement around almost all of the circumference of the signal transmission line with the exception of the portion immediately proximate the detonator.

The length of signal transmission line that is confined along the closed end is a function of the length of the confining wall. In the preferred embodiment the confining wall is about 2–3 cm long. This length confines enough length of the signal transmission lines to insure reliable initiation.

FIG. 10 also illustrates the preferred embodiment of retention block 24. Retention block 24 can have the configuration of a rigid cylindrical sleeve sized for insertion of low strength detonator 30. This configuration frictionally retains the low strength detonator so its closed end is properly disposed in relation to the confining wall. The inside of the retention block can be lined with ridges to further facilitate frictional retention. In an alternative embodiment, the retention block can comprise two parallel lips between which the low strength detonator can be snapped. Other designs can be used as long as they retain the detonator such that the closed end is disposed properly inside the confining wall.

Figure 11:
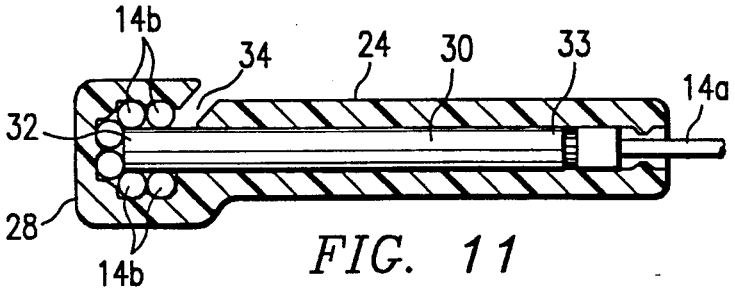
FIG. 11 is a longitudinal cross-sectional view of an alternative embodiment of the detonator assembly.

FIG. 11 illustrates an alternative embodiment of the confining wall in relation to the retention block and low strength detonator. In this embodiment, confining wall 28 surrounds closed end 32 so as to permit the insertion of signal transmission lines transverse to the low strength detonator. The passageway defined by confining wall 28 is transverse to low strength detonator 30. A closure can also be attached to the confining wall to close gap 34.

In the preferred operation, low strength detonator 30 is inserted into retention block 24 so that closed end 32 abuts against stop wall 38. Then one or more signal transmission lines are inserted through gap 34 of confining wall 28 and each one positioned between two ridges 36. If the embodiment is one with closure 42, then closure 42 is closed. A detonation signal is initiated and travels through signal transmission line 14*a* to the low strength detonator. The low strength detonator detonates when it receives the signal. The force of the detonation confined in the confinement block transmits energy into the signal transmission lines 14*b* which become initiated by the absorbed energy. Due to the low strength of the low strength detonator, minimal levels of shrapnel and noise are emitted.

Figure 12:
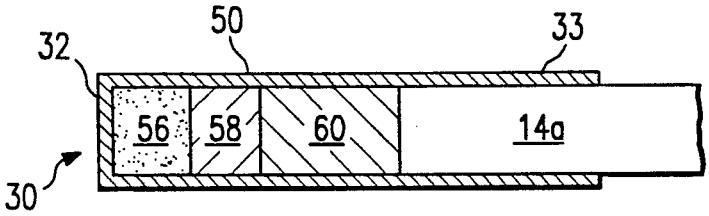
FIG. 12 is a cross-section of a low strength detonator.
Figure 13:
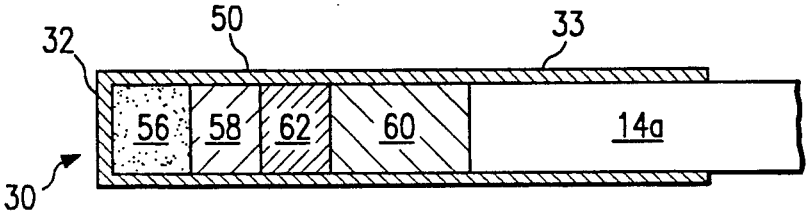
FIG. 13 is a cross-section of a low strength detonator.
Figure 14:
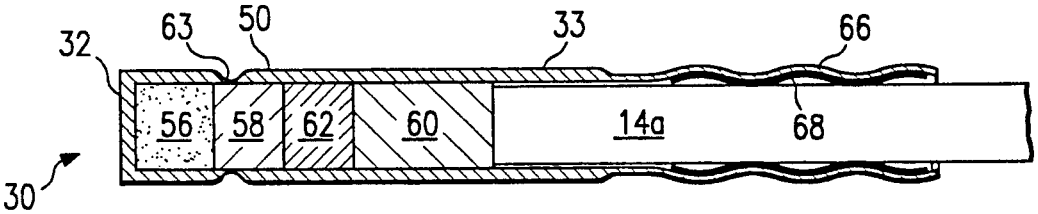
FIG. 14 is a cross-section of the preferred embodiment of the low strength detonator.

FIGS. 12–14 show the low strength detonator 30 with shell 50 having a closed end 32 and open end 33. In the preferred embodiment, a single charge 56 of explosives is confined in the closed end 32. In order to significantly reduce shrapnel and noise the charge should be between about 150 and about 180 mg of explosives or less. In the preferred embodiment, about 125 mg of lead azide is used. Lead styphnate or other types of explosives that reach steady state energy quickly like lead azide or lead styphnate or any mixture thereof can be used as long as the explosive can initiate the signal transmission lines without emitting high levels of noise and/or shrapnel. This is because the energy of the exploding charge is concentrated in a shorter period of time which allows the use of smaller charges.

In the preferred embodiment, a deformable element 58 is adjacent to the charge. The deformable element helps confine detonation energy at the closed end instead of shattering and allow dispersal of the detonation energy. In the preferred embodiment the deformable element also serves as a delay element and can be followed by other standard delay elements 62 as needed followed by a standard attenuator 60 followed by the incoming signal transmission line 14*a*. The deformable element 58 reflects detonation energy instead of shattering, thus reducing shrapnel. It can be made of a malleable metal, lead, aluminum, a deformable plastic or other suitable material or any mixture thereof. It should be appreciated that other arrangements of delay elements and such can be used. Also, in the preferred embodiment of FIG. 14, first crimp 63 is located around deformable element 58 to help retain the element in place upon detonation. The deformability of deformable element 58 plus the retainment of first crimp 63 help confine the energy of single charge 56. Also, second crimp 66 can be used to hold line 14*a* in the shell. Sleeve 68 can be used to seal around signal transmission line 14*a* and keep moisture out of the shell.

Figure 15:
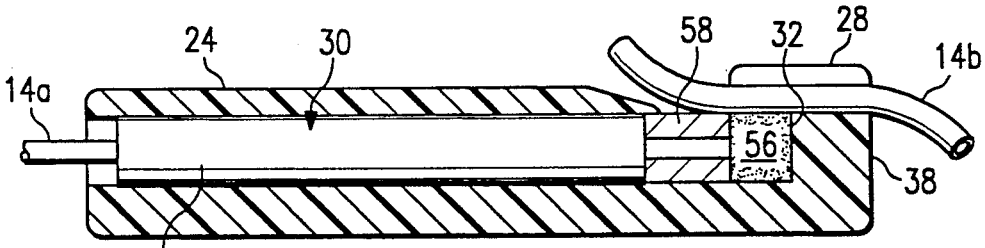
FIG. 15 is a cut-away cross-section of the preferred embodiment of the detonator assembly before detonation.
Figure 16:
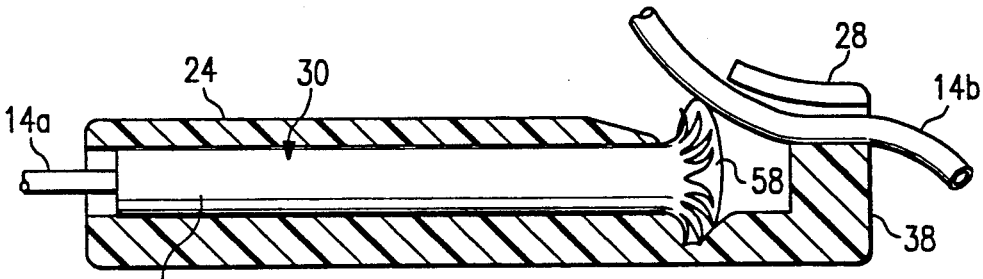
FIG. 16 is a cut-away cross-section of the preferred embodiment of the detonator assembly after detonation.

In operation, deformable element 58 deforms so as to "mushroom" out instead of shattering. FIGS. 15 and 16 illustrate the detonator assembly of the present invention before and after detonation. In FIG. 15, low strength detonator 30 is cut-away to show the position of single charge 56 and deformable delay element 58 relative to signal transmission lines 14*b*, confining wall 28, stop wall 38 and retention block 24. Deformable delay element 58 is disposed outside of confining wall 28. Referring to FIG. 16, upon detonation stop wall 30 reflects the energy of charge 56 back against deformable delay element 58 which mushrooms into the space between retention block 24 and confining wall 28. Confining wall 28 is sufficiently flexible to flex and permit signal transmission line 14*b* to be pushed upward and not cut-off. If deformable delay element 58 did not have sufficient space to expand, the mushrooming of the deformable delay element could cut-off signal transmission line 14*b* before the impact of single charge 56 can be operatively communicated past the deformable delay element. In the preferred embodiment, stop wall 38 is about one (1) cm wide, confining wall 28 is about 1.5 cm wide and the space between retention block 24 and confining wall 28 is about 16 cm wide. This preferred configuration has been found to accommodate the mushrooming of the deformable delay element.

To be commercially useful, the low strength detonator must be able to initiate anywhere from one to about eight signal transmission lines 14*b* confined in the high confinement block of the present invention. This allows the detonator assembly to be adaptable to a variety of blasting patterns and sequences.

Due to the low strength of the charge 56, emission of shrapnel is kept to a low level. This reduces the likelihood of shrapnel cut off. A single 125 mg charge of lead azide reduces noise levels to about 113–116 dB measured at one to three meters from the low strength detonator. A No. 8 cap, which is typically used, puts out about 136–139 dB measured at one to three meters. Due to the dB scale being logarithmic, a 20–26 dB difference is extremely significant. The low noise of the detonator assembly of the present invention allows it to be used in more populated areas which are more sensitive to high noise explosives.

A high confinement connection block as described by the preceding detailed description but not combined with the low strength detonator is another aspect of the invention. The high confinement connection block can be made to accommodate any pre-selected detonator. This aspect of the invention increases versatility by allowing anywhere from 1 to about 8 signal transmission lines to be connected and initiated by a detonator. Also, the signal transmission lines do not have to be threaded end first through the block but instead can be placed through the gap and alongside a detonator.

The low strength detonator described by the preceding detailed description, but not combined with the high confinement connection block, is another aspect of the invention. The low strength detonator can be used to initiate signal transmission lines confined in any appropriately designed connection block. This aspect of the invention reduces the shrapnel and noise due to the low strength charge.

While one embodiment of the present invention has been illustrated in the accompanying drawings, and described in the foregoing Detailed Description, it will be understood that the invention is not limited to the embodiment disclosed, but is capable of numerous rearrangements, modifications and substitutions of parts and elements without departing from the spirit of the invention.

We claim:

1. A low noise, low shrapnel detonator assembly for initiating signal transmission lines, comprising:

(a) a low strength detonator with a closed end and between about 75 to about 150 mg of explosives contained in said closed end;

(b) a high confinement connection block with a first and a second end which houses said low strength detonator;

(i) said first end comprising a retention block which holds said low strength detonator with said closed end exposed;

(ii) said second end comprising a confining wall extended from said retention block that surrounds said closed end of said low strength detonator, said confining wall having a gap through which one to a plurality of signal transmission lines can be inserted and operatively confined adjacent said closed end between said confining wall and said closed end.

2. The detonator assembly of claim 1 wherein said retention block comprises a cylindrical sleeve into which said low strength detonator can be inserted and frictionally retained.

3. The detonator assembly of claim 1 wherein said retention block comprises two parallel lips joined together and dimensioned so said low strength detonator can be snapped between said lips.

4. The detonator assembly of claim 1 wherein said explosives constitute a single charge.

5. The detonator assembly of claim 4 wherein the majority of said single charge is selected from the group consisting of lead azide, lead styphnate or a mixture thereof.

6. The detonator assembly of claim 4 wherein between about 80 to 125 mg of explosives are contained in said closed end.

7. The detonator assembly of claim 1 further comprising a deformable element adjacent said explosives in said closed end of said low strength detonator.

8. The detonator assembly of claim 7 wherein said deformable element is also a delay element.

9. The detonator assembly of claim 7 wherein the majority of said deformable element is selected from the group consisting of malleable metal, lead, aluminum, a deformable plastic, or a mixture thereof.

10. The detonator assembly of claim 7 further comprising a crimp in said low strength detonator located so as to hold said deformable element in place inside said low strength detonator.

11. The detonator assembly of claim 1 wherein said confining wall is of a generally cylindrical shape with a first open end towards said retention block and a second open end away from said retention block and with said gap running lengthwise, said confining wall oriented so as to define an annular passageway concentric with said closed end.

12. The detonator assembly of claim 11 wherein the inside surface of said confining wall is contoured to create a plurality of longitudinal channels, each channel sized to operatively confine a single signal transmission line alongside said closed end of said low strength detonator.

13. The detonator assembly of claim 11 further comprising ridges protruding from the inside surface of said confining wall and running parallel to said low strength detonator, said ridges spaced on the inside surface such that a single signal transmission line can be inserted operatively adjacent said closed end between two of said ridges.

14. The detonator assembly of claim 11 further comprising a stop wall attached at said second open end of said confining wall such that said closed end is abutted against said stop wall.

15. The detonator assembly of claim 11 wherein said confining wall is oriented so that said annular passageway is transverse to said closed end of said long strength detonator.

16. The detonator assembly of claim 11 further comprising a closure extending from said confining wall on each side of said gap and closeable over said gap.

17. The detonator assembly of claim 16 further comprising at least one living hinge lengthwise along said confining wall so that said confining wall can be rotated about said at least one living hinge.

* * * * *